US011136835B2

(12) United States Patent
Panda et al.

(10) Patent No.: US 11,136,835 B2
(45) Date of Patent: Oct. 5, 2021

(54) METHODS TO ATTACH HIGHLY WEAR RESISTANT MATERIALS TO DOWNHOLE WEAR COMPONENTS

(71) Applicant: HALLIBURTON ENERGY SERVICES, INC., Houston, TX (US)

(72) Inventors: Krutibas Panda, The Woodlands, TX (US); Brian Lee Doud, Klein, TX (US); Chakrapani Subramaniam, Humble, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/726,456

(22) Filed: Dec. 24, 2019

(65) Prior Publication Data

US 2020/0277825 A1 Sep. 3, 2020

Related U.S. Application Data

(60) Provisional application No. 62/812,064, filed on Feb. 28, 2019.

(51) Int. Cl.

| | |
|---|---|
| ***E21B 17/10*** | (2006.01) |
| ***E21B 4/00*** | (2006.01) |
| ***E21B 10/567*** | (2006.01) |
| ***E21B 4/02*** | (2006.01) |

(52) U.S. Cl.

CPC ..... *E21B 17/1085* (2013.01); *E21B 4/003* (2013.01); *E21B 10/567* (2013.01); *E21B 4/02* (2013.01)

(58) Field of Classification Search

CPC ..... E21B 17/1085; E21B 4/003; E21B 4/02; E21B 10/567

See application file for complete search history.

(56) References Cited

U.S. PATENT DOCUMENTS

| | | | | |
|---|---|---|---|---|
| 8,056,650 | B2 | 11/2011 | Middlemiss et al. | |
| 8,069,935 | B1 | 12/2011 | Miess et al. | |
| 8,517,125 | B2 | 8/2013 | Lockwood | |
| 2011/0220348 | A1* | 9/2011 | Jin | E21B 17/1085 166/244.1 |
| 2012/0067652 | A1 | 3/2012 | Bellin | |
| 2017/0107768 | A1* | 4/2017 | Saini | B22F 7/06 |

FOREIGN PATENT DOCUMENTS

| | | | |
|---|---|---|---|
| EP | 1958688 | A1 | 8/2008 |

OTHER PUBLICATIONS

Korean Intellectual Property Office, International Search Report and Written Opinion, dated Apr. 22, 2020, 13 pages.

* cited by examiner

*Primary Examiner* — Dany E Akakpo

(57) ABSTRACT

The present disclosure provides a system for improving wear resistance of a downhole tool component using a bonded diamond compact (BDC) construct. The BDC construct includes a BDC element and an encapsulation layer bonded to the BDC element. The encapsulation layer may fully encapsulate the BDC element. The downhole tool component may be a drill bit, push the bit pad, or mud motor beating assembly. The BDC construct may be disposed in a plug section of the downhole tool component. The encapsulation layer may form an insulating layer over the BDC element to protect the BDC element from thermal damage during hard-facing or brazing of the BDC construct to the downhole tool component.

20 Claims, 6 Drawing Sheets

METHODS TO ATTACH HIGHLY WEAR RESISTANT MATERIALS TO DOWNHOLE WEAR COMPONENTS

CROSS-REFERENCE TO RELATED APPLICATION(S)

This application claims priority to U.S. Provisional Application No. 62/812,064 filed Feb. 28, 2019, entitled "Methods to Attach Highly Wear Resistant Materials to Downhole Wear Components," the disclosure of which is hereby incorporated by reference in its entirety.

FIELD OF THE DISCLOSURE

This disclosure relates to improving thermal stability of superhard bonded diamond cutting elements used for wear, drilling, drawing and other downhole tools where superhard properties are required. More specifically, this disclosure relates generally to systems and methods of hard-facing and brazing fully or partially encapsulated thermally stable bonded diamond to downhole tool components.

BACKGROUND

A wide variety of bonded diamond compacts (BDCs) can be used in downhole tool components. Usually BDCs are used in drill string mud motor bearings, push the bit pads and drill bit cutting elements. Generally, these prior BDC devices do not incorporate a thermally stable element in the region adjacent to the cutting surface, therefore prior BDC devices tend to have a mismatch in thermal expansion that can cause the interstitial metal to exert a high stress on the diamond lattice, which in turn can lead to fracture of the diamond-to-diamond bonds and shorten the operating life of the compact. Further, prior BDC devices tend to incorporate a non-thermally stable element that readily dissolves carbon from the diamond surface at elevated temperatures, thereby, leading to the conversion of diamond to graphite, which in turn leads to the shortened operating life of the compact.

Common BDCs are formed by subjecting diamond or other superhard particles (such as cubic boron nitride (CBN) and the like) to high-temperatures and high pressure in the presence of a metallic catalyst to form a polycrystalline matrix of inter-bonded particles. This bonding process is typically referred to as "sintering." The metallic catalyst typically remains in the polycrystalline diamond matrix. Well known polycrystalline diamond (PCD) elements typically consist of a facing table of polycrystalline diamond integrally bonded to a substrate of a less hard material, such as cemented tungsten carbide. This material is often referred to as a polycrystalline diamond compact (PDC). PDC is commonly used in downhole tools, such as downhole drill bit assemblies (including drag bits, also called fixed cutter bits; percussion bits; and rolling cone bits, also called rock bits), reamers, stabilizers and tool joints.

Thermal stability in a PDC is desirable in hard rock drilling applications. High temperatures are generated at the leading edge of the PDC tool while cutting rock. These high temperatures can cause degradation of the tool via several mechanisms, two of which are graphitization of the polycrystalline diamond in contact with the interstitial metallic catalyst and thermal expansion of the interstitial metallic catalyst. In the graphitization mechanism, carbon readily dissolved from the diamond surface as the temperature of the cutting tip increases above about 450° C. This dissolving of the carbon is due to the increased saturation level of carbon in the metallic catalyst with increasing temperature. The dissolved carbon takes the form of graphite since the PDC tool operates outside of the thermodynamic stability region of diamond. In the thermal expansion mechanism, this thermal expansion of the metallic catalyst is several times greater than that of diamond for a given increase in temperature. The mismatch in thermal expansion causes the interstitial metal to exert a high stress on the diamond lattice. These stresses can lead to a fracture of diamond-to-diamond bonds at or above about 700° C. and a shortened operating life of the compact.

When BDCs are disposed in plugs located in the outer surface of downhole tool components, a process known as hard-facing is used. Typical hard-facing and induction brazing temperatures for mud motor bearings, push the bit pads and drill bits are over 800° C. The high temperatures can impact seating and lead to significant thermal degradation of the BDC.

DESCRIPTION OF ILLUSTRATIVE EMBODIMENTS

Embodiments of the present disclosure relate to encapsulating superhard compact materials, such as bonded diamond powder or bonded cubic boron nitride powder, with an encapsulation layer to improve thermal stability. The combination of the encapsulation layer and the bonded compact yields a bonded compact construct that can more readily be attached to mud motor bearings, push the bit pad assemblies and drill bit assemblies. In some embodiments, the bonded compact construct may be formed of a bonded diamond compact (BDC). In some embodiments, the bonded compact construct may be formed of a bonded cubic boron nitride compact.

Figure 1:
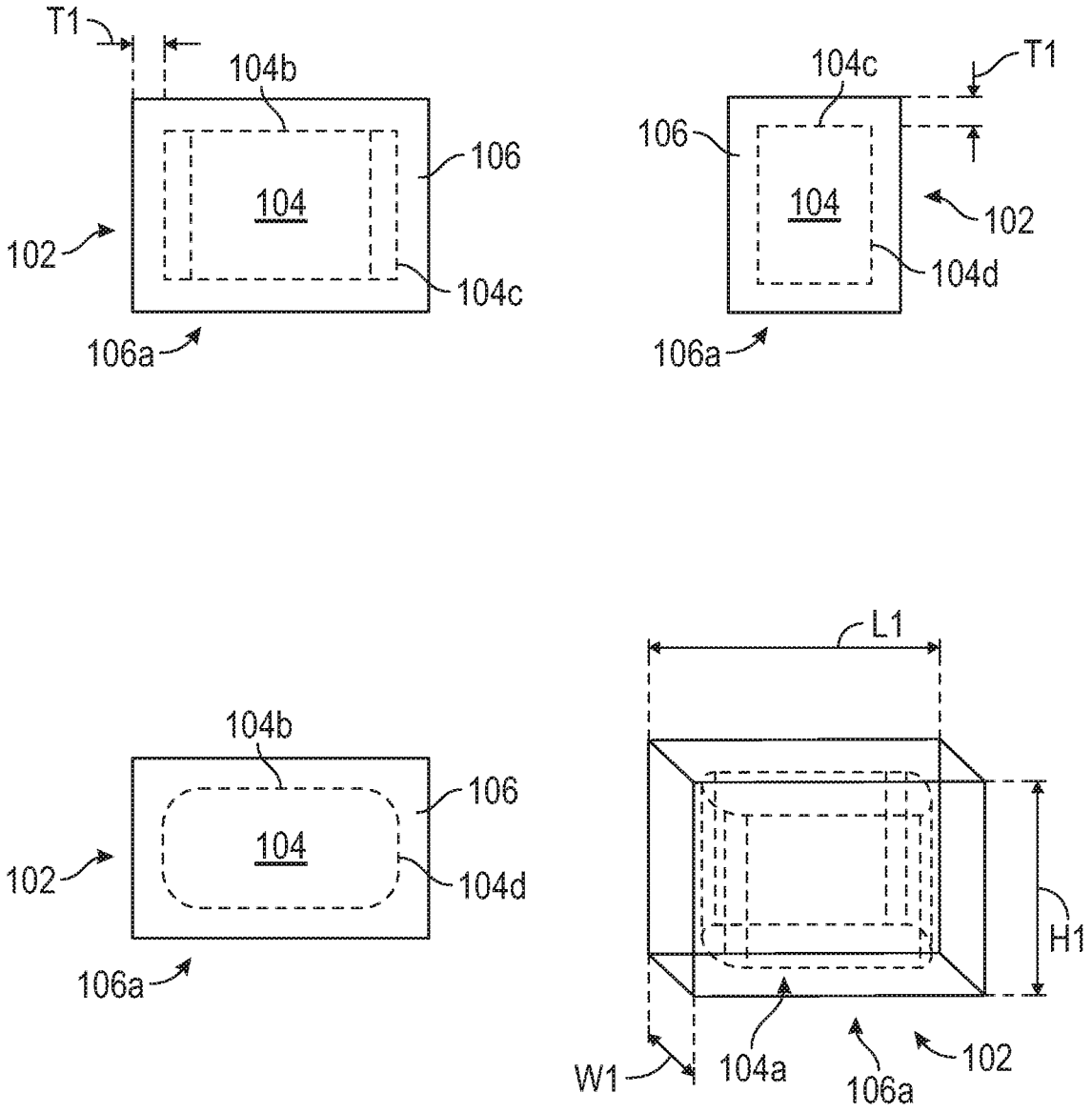
FIG. 1 includes a perspective view and three orthographic views of an example BDC construct having a BDC element fully encapsulated by an encapsulation layer.

FIG. 1 includes a perspective view and three orthographic views of an example BDC construct 102 having a. BDC element 104 fully encapsulated by an encapsulation layer 106. The BDC construct 102 includes a BDC element 104 having an outer surface 104*a*. In one or more embodiments, a material composition of the BDC element 104 includes silicon carbide (SiC) bonded diamond or polycrystalline diamond. In one or more embodiments, the encapsulation layer 106 fully encapsulates the outer surface 104*a* of the BDC element 104. In one or more embodiments, the encapsulation layer 106 includes tungsten carbide (WC) with a variety of other binder matrix (such as Cu, Ni, Zn, Sn etc.). In one or more embodiments, the encapsulation layer 106 may include a mixture of boron nitride and diamond, a mixture of tungsten and carbon, a mixture of two dissimilar metals, or a mixture of a polymer and a metal. In one or more embodiments, the encapsulation layer 106 may form an insulating layer or thermal barrier over the BDC element 104. In one or more embodiments, the encapsulation layer 106 may have a lower thermal conductivity or a higher specific heat compared to the BDC element 104.

The encapsulation layer 106 includes an outer surface 106*a*, as illustrated. In one or more embodiments, the encapsulation layer 106 may have a thickness T1 of about 1.0 mm to 1.5 mm. In one or more embodiments, the thickness T1 may range from about 0.5 mm to about 2.0 mm. In one or more embodiments, the thickness T1 may scale to a dimension of the BDC construct 102, such as ranging from about 10% to about 25% of one of a length L1, width W1, or height H1 of the BDC construct 102, as illustrated. In one or more embodiments, the thickness T1 may vary over the outer surface 104*a*. In one or more embodiments, a portion of the encapsulation layer 106 adjacent an edge 104*b* may be thinner than portions of the encapsulation layer 106 adjacent edges 104*c* and 104*d*. In one or more embodiments, the encapsulation layer 106 may be thicker on one side of the BDC construct 102 compared to an opposing side of the BDC construct 102.

Figure 2A:
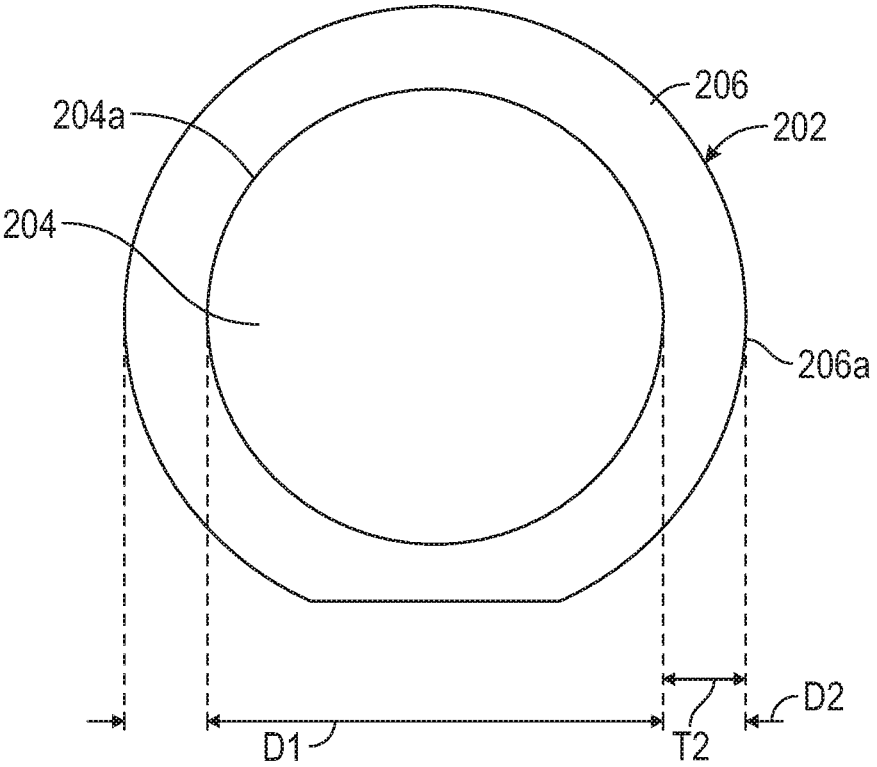
FIG. 2A is a cross-sectional view of a BDC construct exhibiting a generally cylindrical geometry.
Figure 2B:
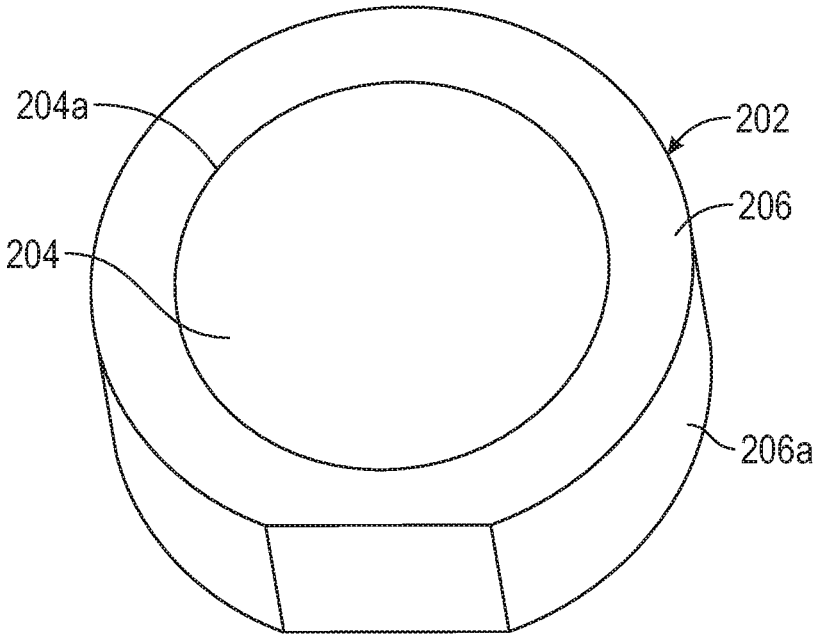
FIG. 2B is a perspective view of the BDC construct of FIG. 2A.

FIG. 2A shows a cross-sectional view of a fully encapsulated high isostatic pressure processed BDC construct 202. FIG. 2B shows a perspective view of the sectioned BDC construct 202 of FIG. 2A. The BDC construct 202 includes a BDC 204 having an outer surface 204*a* surrounded by an encapsulation layer 206 having an outer surface 206*a*. The BDC constructs 202 can include any of the features described for the BDC constructs 102. Likewise, the encapsulation layer 206 can include any of the materials or other features described for the encapsulation layer 106.

In one or more embodiments, the outer surface 204*a* includes a surface feature to increase surface area contact between the outer surface 204*a* and the encapsulation layer 206. The surface feature may include, without limitation, a pattern, texture, topography, surface finish, or surface chemistry. In one or more embodiments, the surface feature may improve bonding of the encapsulation layer 206 to the outer surface 204*a* and help secure the encapsulation layer 206 to the outer surface 204*a*. Thus, an interface is formed between the outer surface 204*a* and the encapsulation layer 206 with improved bonding compared to a flat outer surface 204*a* without the surface feature. In one or more embodiments, the surface feature may include a physical roughness or other topographical feature to increase surface area contact, one or more notches, a surface chemistry, or a combination thereof. In one or more embodiments, the surface chemistry may form at least one of an ionic, covalent, or metallic bond between the outer surface 204*a* and the encapsulation layer 206. In one or more embodiments, the BDC construct 202 may have a cylindrical shape. Although the BDC construct 202 is shown as having a cylindrical shape having a diameter D1, it will be appreciated that the BDC construct 202 can be manufactured and/or processed to have a variety of shapes, including but not limited to ovals, spheres, cylinders, trapezoids, rectangles and squares. The encapsulation layer 206 may have a thickness T2, and the outer surface 206*a* may have an outer diameter D2. In one or more embodiments, the thickness T2 of the encapsulation layer 206 along a longitudinal central axis may be nonuniform. In other embodiments, the thickness T2 along a radial axis may be nonuniform.

Figure 3:
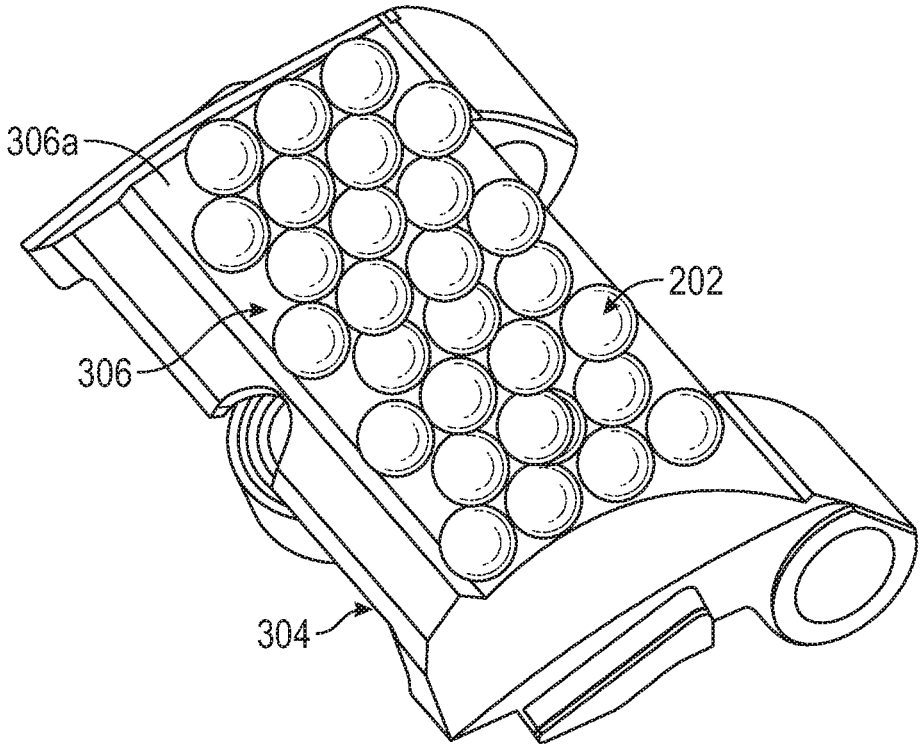
FIG. 3 is a perspective view of a push the bit pad incorporating BDC constructs in accordance with various embodiments.

FIG. 3 shows one application using BDC constructs 202. In this embodiment, a push the bit pad 304 is hard-faced using fully or partially encapsulated BDC constructs 202. The push the bit pad 304 is shown having a plug section 306 including a first surface 306*a*. The plug section 306 includes cavities into which the BDC constructs 202 are received, as described in greater detail below. The BDC constructs 202 may be disposed on the first surface 306*a* and/or in the cavities. The plug section 306 may generally define a radially outer surface of a push the bit pad 304, and thus, faces the wellbore wall when employed in a drilling operation. Additionally, the first surface 306*a* may be disposed on the plug section 306 facing the wellbore wall during drilling. In one or more embodiments, the BDC constructs 202 have a high packing density. In one or more embodiments, the BDC constructs 202 may have a round shape. In one or more embodiments, the BDC constructs 202 may cover substantially all of the first surface 306*a*. In one or more embodiments, the encapsulation layer 106 on the BDC constructs 202 may promote attachment of the BDC constructs 202 to the first surface 306*a*. In one or more embodiments, furnace brazing may be used to bind the BDC constructs 202 to the first surface 306*a*.

Figure 4:
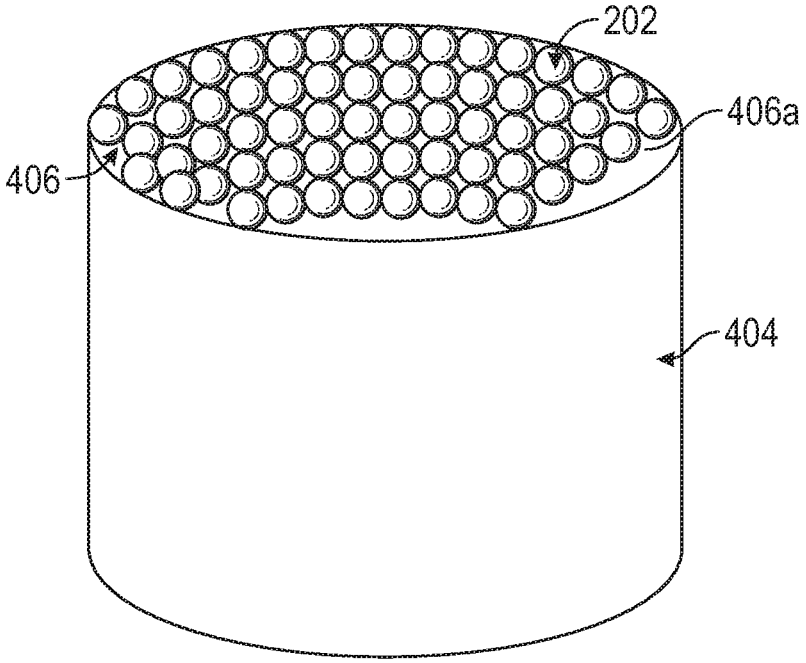
FIG. 4 is a schematic perspective view of mud motor bearing incorporating BDC constructs in accordance with various embodiments.

FIG. 4 is a schematic perspective view of mud motor bearing 404 incorporating BDC constructs 202. As stated above, the BDC constructs 202 can include any of the features of the BDC constructs 102. In this embodiment, a mud motor bearing 404 is hard-faced using fully or partially encapsulated BDC constructs 202. The mud motor beating 404 is shown having a bearing section 406 including a bearing surface 406*a*. The BDC constructs 202 may be disposed on the bearing surface 406*a*. In one or more embodiments, the BDC constructs 202 may have a high packing density. In one or more embodiments, the BDC constructs 202 may have a round shape. In one or more embodiments, the BDC constructs 202 may cover substantially all of the bearing surface 406*a*. In one or more embodiments, the encapsulation layer 106 on the BDC constructs 202 may promote attachment of the BDC constructs 202 to the bearing surface 406*a*.

Figure 5A:
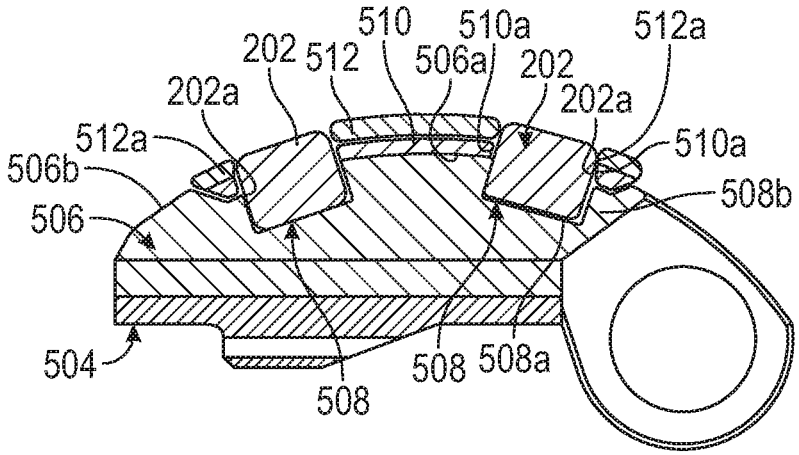
FIG. 5A is a cross-sectional view of a push the bit pad incorporating a tungsten carbide binder cloth, a matrix cloth, and BDC constructs in accordance with various embodiments.
Figure 5B:
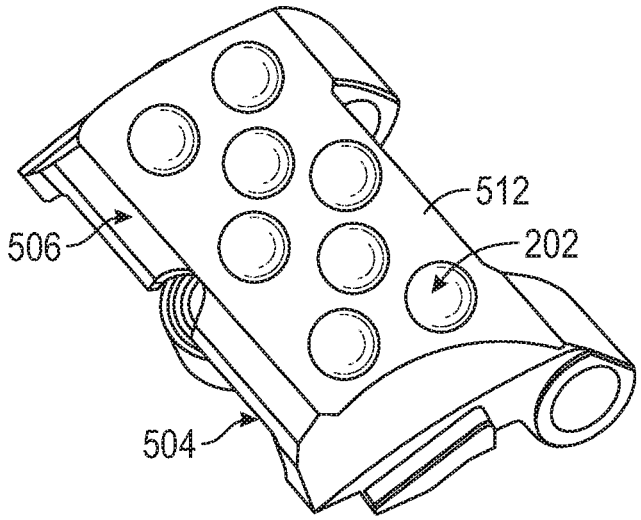
FIGS. 5B and 5C are perspective views of the push the bit pad and the matrix cloth, respectively, of FIG. SA.
Figure 5C:
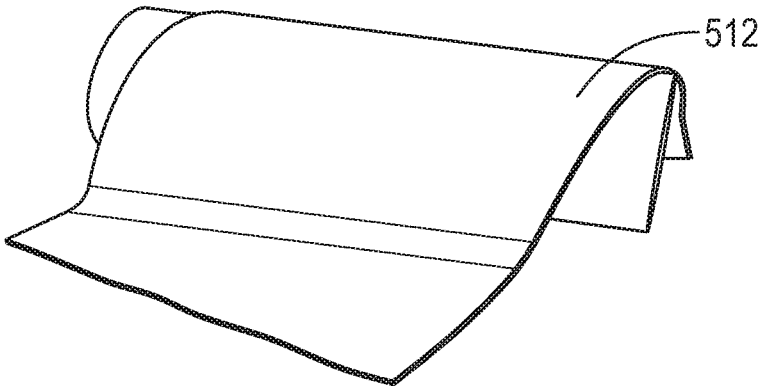

FIGS. 5A-5C show another application using BDC constructs 202. In this embodiment, a push the bit pad 504 is hard-faced using fully or partially encapsulated BDC constructs 202. The push the bit pad 504 is shown having a plug section 506 including a first surface 506*a* and a second surface 506*b*. The second surface 506*b* may be disposed adjacent to the first surface 506*a*. The second surface 506*b* may form a border of the plug section 506. The first surface 506*a* may be recessed relative to the second surface 506*b*. The plug section 506 may be disposed in a portion of the push the bit pad 504 adjacent the wellbore. The first and second surfaces 506*a*, 506*b* may be disposed on the plug section 506 facing the wellbore wall during drilling.

In one or more embodiments, as shown in FIG. 5A, the plug section 506 includes plugs 508 formed through first surface 506*a*. It will be appreciated that the plugs 508 may be formed using a variety of manufacturing methods, including without limitation molding, casting, machining, welding, and additive manufacturing. In one or more embodiments, the plugs 508 may be created by recessing the first surface 506*a*. The plugs 508 may have a circular or polygonal shape. The plugs 508 include a first or bottom surface 508*a* and a second or side surface 508*b*. As shown in FIG.

5A, the BDC constructs 202 are disposed in the plugs 508. In one or more embodiments, the BDC constructs 202 and the plugs 508 each may have a circular shape. In one or more embodiments, the BDC constructs 202 and the plugs 508 may cover substantially all of the first surface 506*a*. In one or more embodiments, the encapsulation layer 106 on the BDC constructs 202 may promote attachment of the BDC constructs 202 to the first and second surfaces 508*a*, 508*b* of the plugs 508. In one or more embodiments, furnace brazing may be used to bind the BDC constructs 202 to the first and second surfaces 508*a*, 508*b*.

In the embodiment shown in FIGS. 5A-5C, the hardfacing process may be performed similarly to a conforma-clad process (cloth-based) to make batch processing of the hard-faced push the bit pad 504 more viable. During a conforma-cladding process, both a WC-based material or binder and a metal matrix material each may be pre-formed as a cloth. The binder and the metal matrix material may be applied to wear surfaces with the metal matrix material disposed over the binder. The resulting construct may be furnace brazed in order to create fully metallurgically bonded hard-facing layers consisting of hard WC particles surrounded by a relatively tough and wear resistant metal matrix.

Referring again to FIG. 5A, after the BDC constructs 202 are installed in the plugs 508, a binder cloth 510 may be disposed on the first surface 506*a*. In one or more embodiments, the binder cloth 510 may include holes 510*a* that contact a side surface 202*a* of the BDC constructs 202. In one or more embodiments, the holes 510*a* may match a shape of the BDC constructs 202 and/or the plugs 508. In one or more embodiments, the binder cloth may be formed of tungsten carbide. After the binder cloth 510 is installed, a matrix cloth 512 may be disposed over the binder cloth 510. In one or more embodiments, the matrix cloth 512 may include holes 512*a* that contact the side surface 202*a* of the BDC constructs 202. In one or more embodiments, the holes 512*a* may match the shape of the BDC constructs 202, the plugs 508 and/or the holes 510*a*. In one or more embodiments, the matrix cloth may be formed of a metal. After the matrix cloth 512 is installed, the push the bit pad 504 may be inserted into a furnace. High temperatures in the furnace may chemically bind together the BDC constructs 202, the push the bit pad 504, the binder cloth 510, and the matrix cloth 512 as shown in perspective view in FIG. 5B. FIG. 5C shows an embodiment of the matrix cloth 512.

Utilizing the cloth-based batch processing procedure described above with reference to FIGS. 5A-5C can produce wear resistant push the bit pads 504 having lower cost, improved reliability and longer life compared to push the bit pads constructed by other processes. The same process can be used in other application, including without limitation mud motor bearings and stabilizer wear surfacing.

Other hardfacing processes may be employed to bind the BDC constructs 202 to the push the bit pad 504 while hardfacing the first surface 506*a*. For example, laser, rope and rod hardfacing, induction brazing and infiltration processes may be employed.

In a laser hardfacing process, a laser beam may be focused to a particular spot size on the first surface 506*a*. A hard metal powder, e.g. a WC powder, may be carried to the focused spot in a stream of inert gas to be deposited through nozzles onto the first surface 506*a*. The laser beam and the nozzles may be moved across the first surface 506*a* in any particular pattern intersecting the constructs 202 in the plugs 508. The energy of the laser binds the powder to itself, the constructs 202 and the first surface 506*a* of the pad 504.

In a rope hardfacing process, a rope constructed with a metallic wire as a core and an exterior skin material comprising a hardfacing mixture of tungsten carbide particles, alloying and binder materials. The first surface 506*a* and the BDC constructs 202 may be hardfaced by progressively melting the rope and allowing the melted material to solidify. An oxyacetylene torch may be used to heat the rope, pad 504 and constructs 202. In a rod hardfacing process, the hardfacing materials may be supplied in the form of an elongate rod. The hardfacing materials may be deposited onto the pad 504 by brazing or welding. For example, in some embodiments, the rod may be used as an electrode in an arc welding process in which an electric arc is induced between the rod and the pad 504 to provide heat to melt and bind the hardfacing materials to the pad.

In an induction brazing process, an induction coil may be employed to provide an electormagnetic field without contacting the pad 504. The electromagnetic field may heat ferrous material in binder matrix applied to the first surface 506*a* and the constructs 202. In an infiltration process, a mold may be formed around the pad 504, and a hardfacing powder may be placed into a cavity defined between the pad and a mold. Thereafter, a molten binder may be permitted to flow into the mold to bind the hardfacing powder to the first surface 506*a* and the constructs 202. In other embodiments, a spray and fuse process maybe employed as described below.

Figure 6:
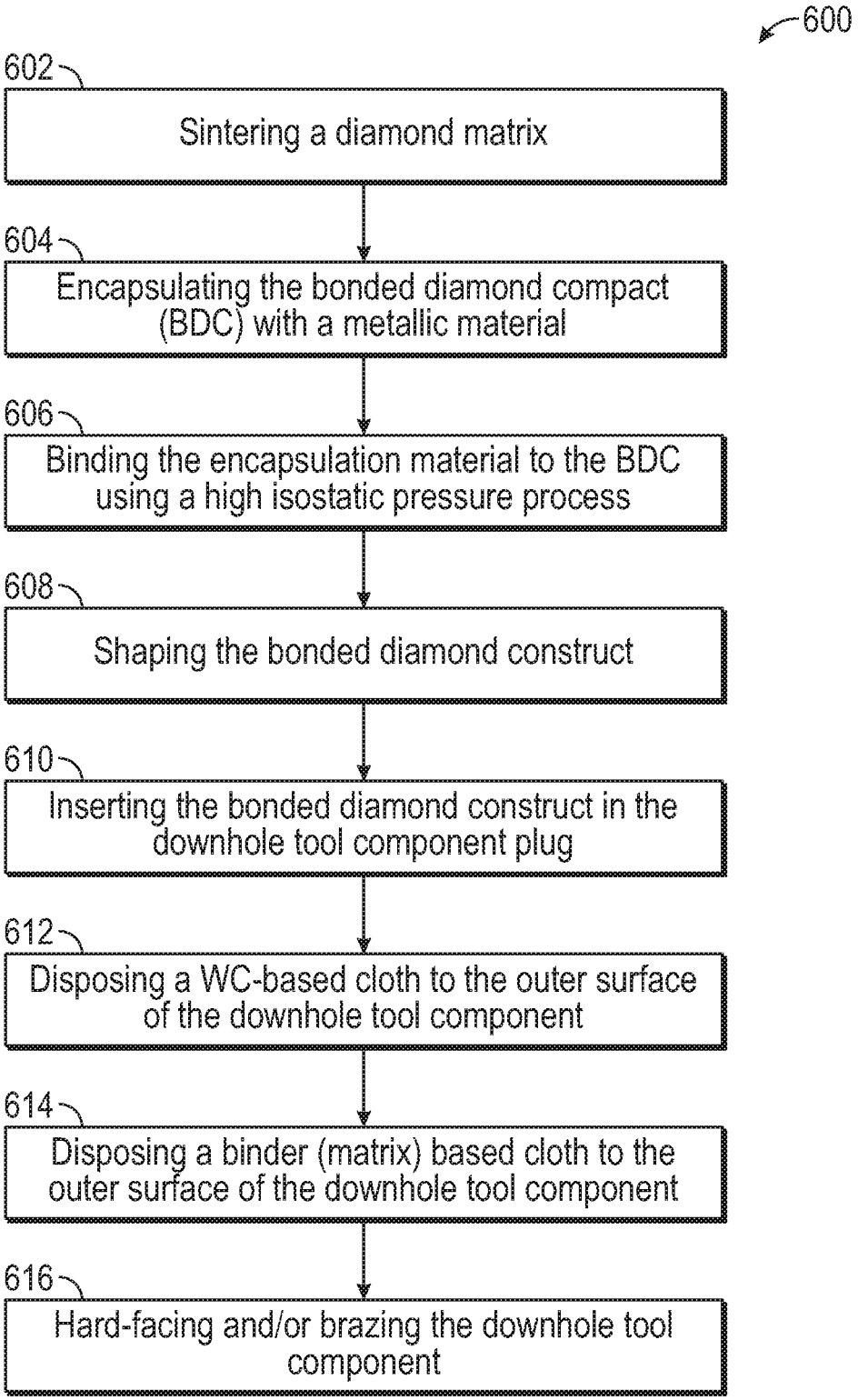
FIG. 6 is a flowchart of a method for producing a wear resistant component of a downhole tool.

In FIG. 6, a process 600 for forming a wear surface for a downhole tool is illustrated in conjunction with the preceding FIGS. 1-5. Without limiting the foregoing, the wear surface may be a push the bit pad 304, 504, a bearing of a mud motor 404, or a face of a drill bit assembly. In a first step 602, referring jointly to FIGS. 2A-2B and FIG. 6, a diamond powder matrix is formed into the BDC element 204. The forming of the BDC element 204 may be performed by sintering the diamond powder matrix. Moreover, while a diamond powder matrix is described, in other embodiments, other materials may be used to form the BDC element 204. In a second step 604, the BDC element 204 is inserted into a mold, and a metallic encapsulation material is added to the mold. The mold establishes the shape of the encapsulation material about the BDC element 204 forming encapsulation layer 206. Next the encapsulation layer 206 is integrally bonded to the BDC element 204 using high isostatic pressure (HIP) as shown in step 606, thus forming the BDC construct 202, as shown in FIGS. 2A-2B. In some embodiments, the BDC element 204 is fully encapsulated by the encapsulation layer 206. In other embodiments, the BDC element 204 is partially encapsulated by the encapsulation layer 206. In one or more embodiments, the degree of encapsulation of the BDC construct 202 may be selected based on the density of BDC constructs 202 on the wear surface and on the temperature utilized in attachment. The degree of partial BDC element 204 encapsulation may vary, such as greater than 66% or greater than 75% or greater than 80% or greater than 90%, with only an upper or to distal most portion being exposed. The exposed portion may be a least likely portion to be affected by temperatures applied adjacent the base of the BDC construct 202 during attachment to the downhole tool. In step 608, the BDC construct 202 is shaped and is prepared for attachment to the wear surface of the downhole tool. Step 608 may include shaping the encapsulation layer 206 using a grinder, laser or electrostatic discharge. In one or more embodiments, the shaping step 608 may be combined with the HIP process 606. In step 610, the BDC construct 202 is disposed on the wear surface of the downhole tool, such as on first surface 306*a* of push the bit pad 304 (FIG. 3) or on bearing surface 406*a* of mud motor bearing 404 (FIG. 4). In one or more embodiments, the process may proceed through optional steps 612 and 614, which describe the conforma-clad like process illustrated in FIGS. 5A-5C. In step 612, the binder cloth 510 is disposed on the wear surface of the downhole tool, such as first surface 506*a* of push the bit pad 504. In step 614, the matrix cloth 512 is disposed over the binder cloth 510. Finally, in step 616, the downhole tool component is hard-faced and/or brazed to permanently attach the BDC construct 202 to the wear surface of the downhole tool component, such as to first surface 306*a* of push the bit pad 304 (FIG. 3) or to bearing surface 406*a* of mud motor bearing 404 (FIG. 4). In one or more embodiments, such as that shown in FIGS. 5A-5C, the wear surface may be first surface 506*a* of push the bit pad 504 and the binder cloth 510, and matrix cloth 512 may be attached in addition to the BDC construct 202. In one or more embodiments, the WC-based material and matrix material may be sprayed on the wear surface of the downhole tool component. Spraying may enable steps 612 and 614 to be combined whereby the WC-based material and the matrix material can be simultaneously applied. The above mentioned is referred to as the spray and fuse process. In a spray and fuse process generally, a combustion powder spray gun is used to deposit a wide variety of powders or other materials onto a substrate, first surface 506*a* (FIG. 5A). The powders may include compositions of Ni, Cr, Co, Bo, Fe, W, WC and diamond powders in varying blends with one another and with a binder matrix powder such as Cu, Ni, Zn, Sn, etc. Once the powder has been deposited on a component to a predetermined thickness, a torch or furnace may be employed to heat the component to approximately 2000 degrees Fahrenheit in some instances. The heat causes the powdered materials to fuse to one another and also to the substrate, thereby forming a metallurgical bond therewith.

Silicon carbide bonded diamond (ScD) as a BDC material offers several advantages over other materials. Although ScD elements offers good thermal stability compared to PCI) elements, ScD elements may be sensitive to temperature degradation when subjected to the very high temperatures required for hard-facing. Using the disclosed process, BDC constructs 202 can now be attached using induction brazing without causing material degradation onto wear surfaces of downhole tools. Furthermore, the packing density of BDC constructs 202 can be improved to increase tool component wear resistance. Moreover, the disclosed process allows BDC constructs 202 to be used in spray and fuse applications and in plasma transferred arc processes. Although the compacts primarily described herein have been formed using bonded diamond powder or bonded cubic boron nitride powder, it will be appreciated that the disclosure need not be limited to such compacts and includes bonded compacts formed of superhard materials.

In one or more embodiments, the hard-facing process may be automated, and/or performed using batch/hulk processing. For example, the BDC constructs 202 may be arranged in a prearranged pattern, after which thermal spray may be applied over the BDC constructs 202. The process may subsequently incorporate a furnace brazing step in a batch process without concerns for heat damage.

Figure 7:
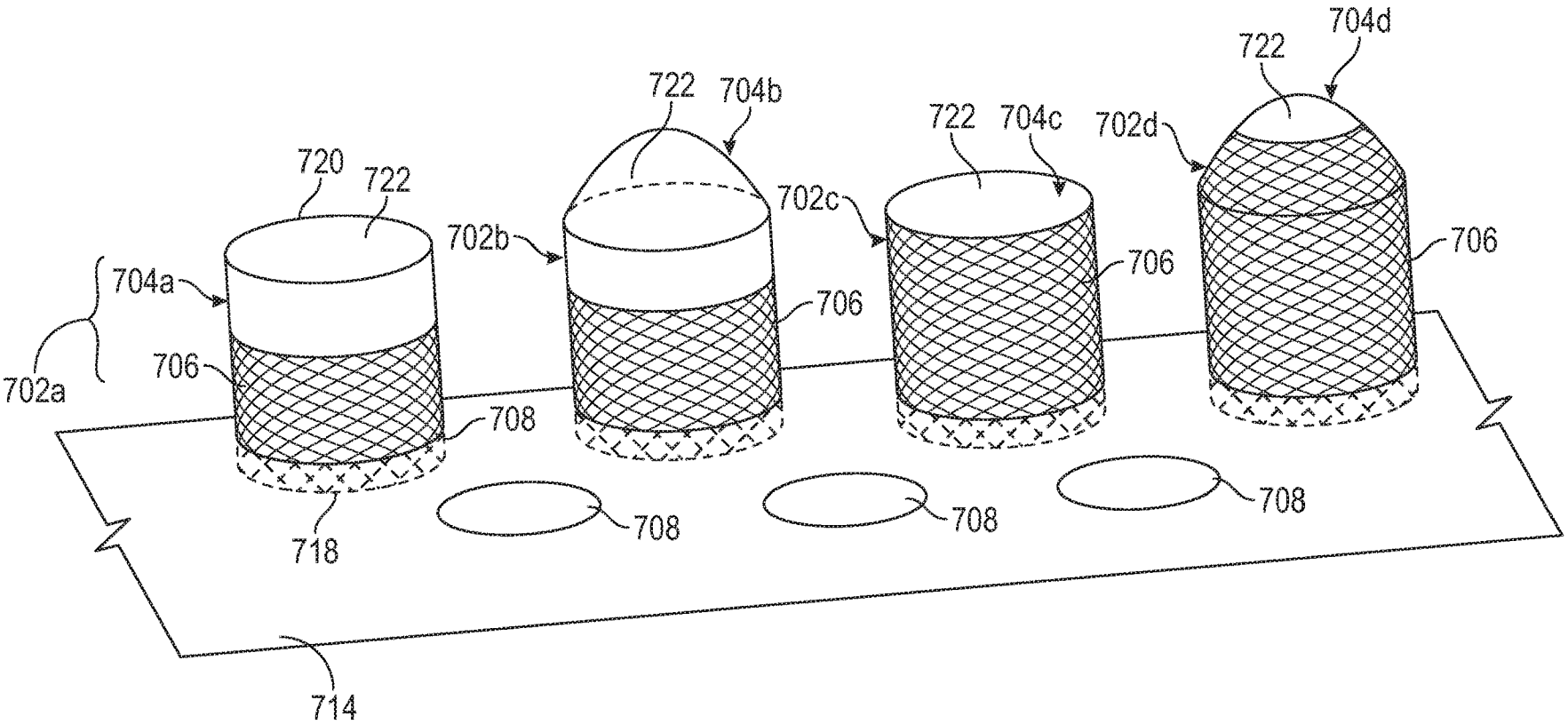
FIG. 7 is a perspective view of BDC constructs illustrating different degrees of partial encapsulation in accordance with various embodiments.

FIG. 7 illustrates different embodiments of partially encapsulated BDC elements 704*a-d* in relation to a wear surface 714. Each illustrated BDC element 704*a-d* is partially encapsulated by an encapsulation layer 706 to form a BDC construct 702*a-d* that may be attached to wear surface 714 by inserting the BDC constructs 702*a-d* into plugs or receptacles 708 formed in wear surface 714. As described above, wear surface 714 may be the surface of a downhole tool component, such as a mud motor bearing, push pad or drill bit surface. Likewise, while plugs 708 may be round for receipt of a circular BDC construct 702*a-d*, in other embodiments, BDC constructs 702*a-d* may be polygonal in shape and plug 708 may likewise have a similar polygonal shape for receipt of the polygonal BDC constructs 702*a-d*.

In any event, the BDC constructs 702*a-d* are shown as having a proximal end 718 and a distal end 720 having a face 722 formed at the distal end 720. BDC constructs 702*a* and 702*c* are each illustrated as having a generally flat face 722, while BDC constructs 702*b* and 702*d* are illustrated as having a shaped face, such as the illustrated domed faces.

As stated above, the degree of partial encapsulation of BDC elements 704*a-d* may vary, with only the upper or distal most portions of BDC constructs 702*a-d* (relative to the proximal end 718) having BDC elements 704*a-d* exposed. It will be appreciated that the exposed portions may be a least likely portion to be affected by temperatures applied adjacent the proximal end 718 of the BDC constructs 702*a-d* during attachment to the wear surface 714. Thus, encapsulation layer 706 is shown encapsulating BDC elements 704*a-d* at the proximal end 718 of the BDC constructs 702*a-d* and extending at least partially along the length of the BDC elements 704*a-d* towards the distal end 720 of the BDC constructs 702*a-d*. In BDC construct 702*a*, encapsulation layer 706 extends around approximately 50% of the length of BDC element 704*a*, while on BDC construct 702*b*, encapsulation layer 706 extends around approximately 90% of the length of BDC element 704*b*. On BDC construct 702*c*, encapsulation layer 706 encapsulates or covers all but the face 722 of BDC construct 702*c*. Finally, on BDC construct 702*d*, encapsulation layer 706 encapsulates or covers all of the body of BDC element 704*d* and a portion of the face 722 of BDC construct 702*d*, leaving a portion of the face exposed and not covered by encapsulation layer 706.

It is desirable to provide improved thermal stability in BDCs. It is particularly desirable to provide such improved stability by incorporating in the design of the BDC construct an encapsulation layer including a thermally stable metal element, the encapsulation layer surrounding an outer surface of the BDC, encapsulating the BDC, and forming a chemically bonded interface. In some embodiments, the BDC is fully encapsulated, while in other embodiments, the BDC is sufficiently encapsulated so as to prevent heat damage to the BDC during attachment of the BDC to a downhole tool wear component such as onto mud motor bearings, push the bit pads, and drill bit cutting faces.

Typically, downhole tool components incorporate wear or cutting elements hard-faced on various parts that push against the formation. These parts may include pads or pistons. One challenge is that the abrasive wear on these parts can be extreme, therefore requiring a very effective hard-facing. Technologies utilizing laser cladding and spray & fuse (or PTA) applied tungsten-carbide (WC) tiles suffer from accelerated wear. Other hard materials (such as silicon carbide (SiC) bonded diamond, polycrystalline diamond) may provide excellent wear properties but suffer from a variety of issues such braze wettability as well as temperature sensitivity. For example, thermal damage to a PDC during hard-facing procedures is common and can result in the diamond matrix cracking and losing integrity under thermal stress.

Moreover, BDCs can be difficult to attach to downhole tool components. It is often necessary to employ multiple attachment techniques. For example, the silicon carbon bonded diamond (ScD) may employ Ni-coating, CVD based tungsten coatings, nanostructured W-WC coatings, Ti coating, foil wrap, carbide shoe encapsulation, etc. Most of these techniques either perform inadequately during brazing/hard-facing or have field issues as a result of lack of interfacial strength. For example, a mud motor bearing may include embedded wear elements. A mud motor bearing typically requires bearings that possess superior wear resistance, thermal stability, and a low dynamic friction coefficient in order to extend useful wear life. Current WC tile-based or laser cladded bearings suffer heat damage, accelerated wear and relatively high dynamic friction coefficients. Thus, mud motor wear surfaces may experience failures due to the lack of adequate interfacial strength. Where WC tiles are used to create a wear surface on a bearing, the wear tile may crack under thermal stress during the hard-facing process or thermal damage under operation as a result of higher dynamic friction coefficients between WC based mating surfaces. BDCs on the other hand can provide much better thermal stability and much improved dynamic friction coefficients. However, they are difficult to attach, weld, and/or braze as a result of either lack of electrical conductivity and/or wettability.

Illustrative embodiments disclose a method to process these hard materials, such as BDCs, with encapsulating material using a high isostatic pressure process. In one or more embodiments, encapsulating the BDCs generates an effective thermal barrier to heat damage either during hard-facing or during brazing.

In one or more embodiments, the high isostatic pressure process provides significantly better interfacial strength between the BDC and encapsulating material over current encapsulation techniques that use either a low strength brazing or an ineffective nickel or titanium plating. In addition, the disclosed encapsulated BDC constructs offers improved interfacial strength when compared to a foil, coated, or carbide shoe techniques commonly used. The encapsulation process also increases weldability and brazeability with a fully customizable chemistry in the encapsulation layer.

In one or more embodiments, the dynamic friction coefficient for mud motor bearing applications is increased as a result of incorporating the BDC constructs on the bearing surfaces.

In one or more embodiments, encapsulation of the BDC construct greatly improves shaping ability. BDCs can be very difficult to grind and experience cracking failures during grinding. BDCs can also be very difficult to electrostatically shape and electrostatically finish due to the limited electrical conductivity. Encapsulation can be optimized to have a required thermal stability to facilitate grinding and electrostatic shaping/finishing since the encapsulation layer is customizable. The embodiments illustrated herein show various encapsulation options, where the encapsulation layer fully or partially envelopes the BDC. As used herein, "full" encapsulation refers to a BDC that is completely enclosed within the encapsulation layer, while "partial" encapsulation refers to a BDC where the encapsulation layer encloses at least that portion of the BDC most susceptible to thermal degradation during attachment to a substrate. For example, a base or proximal end of the BDC may be encased in the encapsulation layer and the encapsulation layer may extend up and around the BDC with only a portion of the top or distal most end or face of the BDC exposed. The encapsulation of the BDC could be symmetrically disposed about the outer surface of the BDC along the central longitudinal axis of the BDC compact. In one or more embodiments, the encapsulation layer could be disposed asymmetrically on the outer surface of the BDC along the central longitudinal axis of the BDC. In one or more embodiments, the encapsulation layer could be disposed symmetrically on the outer surface of the BDC along the central longitudinal axis of the BDC and asymmetrically along the transverse axis of the BDC.

The above specific example embodiments are not intended to limit the scope of the claims. The example embodiments may be modified by including, excluding, or combining one or more features or functions described in the disclosure.

Thus, a wear component for a downhole tool has been described. The downhole tool may be a drill bit assembly, and include a drill bit, a plug section located within an outer surface of the drill bit or push the bit pad; a diamond material compact; a substrate located on said bonded diamond material compact; an encapsulation material bonded to said substrate using a high isostatic pressure, wherein the encapsulation material fully envelopes the bonded diamond material compact; and the fully enveloped diamond material compact is disposed within the plug section of the drill bit or a push the bit pad. The downhole tool may be a drill bit assembly, and include a drill bit, a plug section located within an outer surface of the drill bit or push the bit pad; a diamond material compact; a substrate located on said bonded diamond material compact; an encapsulation material bonded to said substrate using a high isostatic pressure, wherein the encapsulation material at least partially envelopes the bonded diamond material compact; and the at least partially enveloped diamond material compact is disposed within the plug section of the drill bit or a push the bit pad. In other embodiments, the downhole tool may be a mud motor assembly having a mud motor bearing; a plug section located within an outer surface of the mud motor bearing; a diamond material compact; a substrate located on said bonded diamond material compact; an encapsulation material bonded to said substrate using a high isostatic pressure, wherein the encapsulation material fully envelopes the bonded diamond material compact; and the fully enveloped diamond material compact is disposed within the plug section of the mud motor bearing. In other embodiments, the downhole tool may be a mud motor assembly having a mud motor bearing; a plug section located within an outer surface of the mud motor bearing; a diamond material compact; a substrate located on said bonded diamond material compact; an encapsulation material bonded to said substrate using a high isostatic pressure, wherein the encapsulation material at least partially envelopes the bonded diamond material compact; and the at least partially enveloped diamond material compact is disposed within the plug section of the mud motor bearing. In other embodiments, the downhole tool may be a mud motor assembly having a mud motor bearing; a plug section located within an outer surface of the mud motor bearing; a bonded material compact; a substrate located on said bonded material compact; an encapsulation material bonded to said substrate using a high isostatic pressure, wherein the encapsulation material at least partially envelopes the bonded material compact; and the at least partially enveloped bonded material compact is disposed within the plug section of the mud motor bearing. The downhole tool may be a drill bit assembly, and include a drill bit or push pad, a plug section located within an outer surface of the drill bit or push the bit pad; a superhard material compact; a substrate located on said superhard material compact; an encapsulation material bonded to said substrate using a high isostatic pressure, wherein the encapsulation material fully or partially envelopes the superhard material compact; and the fully or partially enveloped superhard material compact is disposed within the plug section of the drill bit or a push the bit pad. The downhole tool may an apparatus for drilling a subterranean formation, the apparatus including a plug section located within an outer surface of the apparatus; a superhard material compact; a substrate located on said superhard material compact; an encapsulation material bonded to said substrate using a high isostatic pressure, wherein the encapsulation material fully or partially envelopes the superhard material compact; and the fully or partially enveloped superhard material compact is disposed within the plug section of the outer surface of the apparatus.

Any one or more of the above-described downhole tool embodiments may include any one or more of the following elements, alone or in combination:

The diamond material compact is a sintered bonded diamond material compact.

The substrate has a bottom surface, a top surface and has a peripheral edge on said top surface.

The superhard material compact is a bonded diamond compact.

The superhard material compact is a bonded cubic boron nitride compact.

The bonded material compact is a bonded diamond compact.

The bonded material compact is a bonded cubic boron nitride compact. The material compact is formed of powder of a superhard material.

The superhard material is diamond powder.

The superhard material is cubic boron nitride powder.

The bonded diamond material compact has a proximal end and a distal end with a face defined at the distal end.

The encapsulation material encapsulates all but the face of the bonded diamond material compact.

The face of the bonded diamond material compact is substantially flat.

The face of the bonded diamond material compact is shaped.

The face of the bonded diamond material compact is domed.

A portion of the face is covered by the encapsulation material and a portion of the face is exposed.

A portion of the length of the bonded diamond material compact s covered by the encapsulation material.

A portion of the domed face is covered by the encapsulation material and a portion of the domed face is exposed.

A substrate surface topographical feature is located on said substrate to increase surface area contact between the substrate and the encapsulation material, The encapsulation material and the substrate form an interface between said encapsulation material and said substrate to secure said encapsulation material to said substrate.

The interface between the encapsulation material and the substrate is a chemical bond.

The sintered bonded diamond material compact is a polycrystalline diamond composite.

The sintered bonded diamond material compact is a silicon-carbide diamond composite.

The encapsulation material is a mixture of boron nitride and diamond.

The encapsulation material is mixture of tungsten and carbon.

The encapsulation material is mixture of two dissimilar metals.

The encapsulation material is mixture of a polymer and a metal.

An encapsulation material thickness is varied to adjust a thermal barrier.

The fully enveloped bonded diamond material is hard-faced to the drill bit, mud motor bearing, or push the bit pad.

The fully enveloped bonded diamond material is brazed to the drill bit, mud motor bearing, or push the bit pad.

The plug section is made up of at least one plug of a plurality of plugs.

The at least one plug of the plurality of plugs is antisymmetric.

The encapsulation material is shaped to fit the dimensions of the at least one plug of the plurality of plugs.

The encapsulation material is shaped using electrostatic discharge.

The encapsulation material is shaped using a grinder.

The encapsulation material is shaped using a laser.

The high isostatic pressure process is automated.

The plurality of plugs is densely packed.

The plug section is surrounded by a tungsten carbide binder cloth chemically coupled to an outer surface of the drill bit, mud motor beating, or push the bit pad.

The plug section is surrounded by a matrix cloth chemically coupled to an outer surface of the drill bit, mud motor bearing, or push the bit pad.

The plug section is surrounded by a tungsten carbide binder cloth forms a first layer chemically coupled to the outer surface of the drill bit, mud motor bearing, or push the bit pad and a matrix cloth forms a second layer chemically coupled to the first layer about the outer surface of the drill bit, mud motor bearing, or push the bit pad.

An encapsulation material is thicker on one side of the bonded diamond compact side compared to an opposing side of the bonded diamond compact.

An encapsulation material thickness along the longitudinal central axis, extending radially outward from the longitudinal central axis, is nonuniform.

An encapsulation material thickness along the radial axis is nonuniform.

An encapsulation material outer surface is notched.

Likewise, a method for making a diamond construct for attachment to a downhole tool component has been described. In one or more embodiments, the method may include the steps of sintering a diamond matrix powder forming a bonded diamond compact; fully or partially encapsulating the bonded diamond compact with a metallic material; binding the encapsulation material to the bonded diamond compact using a high isostatic pressure forming a diamond construct; inserting the diamond construct into a plug section on the outer of the downhole tool component; and hard-facing and/or brazing the downhole tool component. In other embodiments, the method may include the steps of providing a bonded diamond compact; fully or partially encapsulating the bonded diamond compact with a metallic material; binding the encapsulation material to the bonded diamond compact for form a diamond construct; inserting the diamond construct into a plug section of the downhole tool component; and attaching the diamond construct to the downhole tool component. In other embodiments, the method may include the steps of providing a bonded compact of superhard material; fully or partially encapsulating the bonded compact with a metallic material;

binding the encapsulation material to the bonded compact for form a construct; inserting the construct into a plug section of the downhole tool component; and attaching the construct to the downhole tool component.

Any one or more of the above-described method embodiments may include any one or more of the following, alone or in combination:

Providing a bonded diamond compact comprises sintering a diamond matrix powder to form a bonded diamond compact.

Binding the encapsulation material to the bonded diamond compact comprises using a high isostatic pressure to form a diamond construct.

Attaching the diamond construct comprises hard-facing the diamond construct to the downhole tool component.

Attaching the diamond construct comprises brazing and construct to the downhole tool component.

Varying the encapsulation material thickness to adjust a thermal barrier.

Shaping the encapsulation material to fit the dimensions of the at least one plug of the plurality of plugs.

Shaping the encapsulation material once the diamond construct is formed.

Shaping the encapsulation material using electrostatic discharge.

Shaping the encapsulation material by grinding the encapsulation material.

Utilizing a laser to shape the encapsulation material.

The high isostatic pressure process is automated.

Forming a plug in a surface of the downhole tool component.

Forming a plurality of plugs in a surface of the downhole too component.

The plurality of plugs is densely packed.

Positioning a metallic cloth on the outer surface of the downhole tool component.

Positioning a matrix cloth is disposed on the outer surface of the downhole tool component.

Positioning a tungsten carbide binder cloth that forms a first layer chemically coupled to a surface of the downhole tool component and positioning a matrix cloth over the tungsten carbide binder cloth so as to form a second layer chemically coupled to the first layer.

What is claimed is:

1. A downhole tool, comprising:

a plug section located within an outer surface of the downhole tool;

a bonded diamond compact (BDC) construct including:

a BDC element; and an encapsulation layer at least partially encapsulating the BDC element, wherein the BDC construct is disposed within the plug section of the downhole tool;

a tungsten carbide binder cloth chemically coupled to a surface of the plug section and forming a first layer thereon; and a metal matrix cloth chemically coupled to the first layer and forming a second layer on the surface of the plug section.

2. The downhole tool of claim 1, wherein the encapsulation layer fully encapsulates the BDC element.

3. The downhole tool of claim 1, comprising at least one of the soup consisting of a drill bit, a push-the-bit pad and a mud motor bearing assembly.

4. The downhole tool of claim 1, wherein the BDC element and the encapsulation layer form an interface there between to secure the encapsulation layer to the BDC element.

5. The downhole tool of claim 4, wherein the interface between the BDC element and the encapsulation layer includes a chemical bond.

6. The downhole tool of claim 1, wherein the encapsulation layer includes at least one of a mixture of boron nitride and diamond, a mixture of tungsten and carbon and combinations thereof.

7. The downhole tool of claim 1, wherein the first and second layers are chemically coupled to the BDC construct.

8. A wear resistant downhole tool component assembly, comprising:

a wear surface defined on one of the group consisting of a drill bit, a push the bit pad, and a mud motor hearing assembly, wherein the wear surface includes a plug section having a plurality of plugs; and a BDC construct attached to the wear surface, wherein the BDC construct is attached to bottom and side surfaces of a plug of the plurality of plugs, the BDC construct including a BDC element and an encapsulation layer fully encapsulating the BDC element, wherein the encapsulation layer forms an insulating layer over the BDC element.

9. The assembly of claim 8, wherein the encapsulation layer has a lower thermal conductivity than the BDC element.

10. The assembly of claim 8, wherein the encapsulation layer has a higher specific heat than the BDC element.

11. The assembly of claim 8, wherein the BDC construct has a cylindrical shape.

12. The assembly of claim 8, wherein the encapsulation layer has a uniform thickness.

13. The assembly of claim 8, wherein the encapsulation layer includes a mixture of a polymer and a metal.

14. A downhole tool, comprising:

a plug section defined on an outer surface of the downhole tool, the plug section including a plurality of cavities therein;

a plurality of BDC constructs, each BDC construct received in a cavity of the plurality of cavities, and each BDC construct formed of a bonded diamond compact (BDC) element fully encapsulated by and chemically bonded to an encapsulation layer; and a hardfacing material bonded to the outer surface of the downhole tool and the encapsulation layer to attach the BDC construct to the plug section.

15. The downhole tool of claim 14, wherein the downhole tool is one of a group consisting of a drill bit, a push the bit pad, and a mud motor bearing assembly.

16. The downhole tool of claim 14, wherein the BDC construct includes a domed shaped face protruding from the outer surface of the downhole tool.

17. The downhole tool of claim 14, wherein the encapsulation layer has a lower thermal conductivity than the BDC element.

18. The downhole tool of claim 14, further comprising a binder cloth disposed over the plug section and a matrix cloth over the binder cloth.

19. The downhole tool of claim 14, wherein the encapsulation layer is disposed asymmetrically on an outer surface of the BDC element.

20. The downhole tool of claim 14, wherein the encapsulation layer is constructed of a metallic material.

* * * * *